US011638928B2

(12) United States Patent
Gould et al.

(10) Patent No.: US 11,638,928 B2
(45) Date of Patent: May 2, 2023

(54) DISPENSER WITH CLOSED LOOP CONTROL

(71) Applicant: NORDSON CORPORATION, Westlake, OH (US)

(72) Inventors: Mark Aaron Gould, Gainesville, GA (US); Brandon D. Conner, Tucker, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 17/680,422

(22) Filed: Feb. 25, 2022

(65) Prior Publication Data

US 2022/0176403 A1 Jun. 9, 2022

Related U.S. Application Data

(62) Division of application No. 16/389,061, filed on Apr. 19, 2019, now Pat. No. 11,292,024.
(Continued)

(51) Int. Cl.
*B05C 5/02* (2006.01)
*B05C 11/10* (2006.01)
*B05C 21/00* (2006.01)

(52) U.S. Cl.
CPC ..... *B05C 5/0225* (2013.01); *B05C 5/0291* (2013.01); *B05C 11/1034* (2013.01); *B05C 21/00* (2013.01)

(58) Field of Classification Search
CPC . B05C 5/0225; B05C 5/0291; B05C 11/1034; B05C 21/00; B05B 1/3046;
(Continued)

(56) References Cited

U.S. PATENT DOCUMENTS 7,740,225 B1 * 6/2010 Estelle ..... F16K 31/0665 251/129.05
2003/0132243 A1 7/2003 Engel
(Continued)

FOREIGN PATENT DOCUMENTS

WO 2009/104421 A1 8/2009
WO 2017/040648 A1 3/2017

OTHER PUBLICATIONS

European search report dated Sep. 9, 2019 for EP Application No. 19171933.

*Primary Examiner* — Darren W Gorman
(74) *Attorney, Agent, or Firm* — BakerHostetler

(57) ABSTRACT

A system and method for controlling a needle motion of a material applicator are disclosed. The system includes an actuator assembly that contains a piezoelectric device, where the actuator assembly is connected to a needle and translates the needle along a vertical direction, and a sensor assembly that includes an emitter for emitting light, where a portion of the actuator assembly occludes a portion of the light. The sensor assembly also includes a receiver for receiving a non-occluded portion of the light and a sensor holder that secures the emitter and the receiver. The system further includes a controller in electrical communication with the piezoelectric device, emitter, and receiver, where the controller adjusts operation of the actuator assembly based on feedback received from the receiver.

25 Claims, 8 Drawing Sheets

Related U.S. Application Data

(60) Provisional application No. 62/667,696, filed on May 7, 2018.

(58) Field of Classification Search
CPC ..... B05B 12/00; B05B 12/004; B05B 12/082; B05B 17/04; B05B 17/0607; H05K 13/0469; H05K 13/081; H02N 2/04; H02N 2/067
See application file for complete search history.

(56) References Cited

U.S. PATENT DOCUMENTS

| | | | | |
|---|---|---|---|---|
| 2014/0124600 | A1* | 5/2014 | Ciardella | B41J 2/045 239/569 |
| 2016/0031030 | A1* | 2/2016 | Bergstrom | H05K 3/3489 118/697 |
| 2016/0129467 | A1 | 5/2016 | Ciardella et al. | |
| 2016/0136661 | A1* | 5/2016 | Hong | B05C 5/0225 239/1 |
| 2018/0086094 | A1 | 3/2018 | Sakai et al. | |

* cited by examiner

DISPENSER WITH CLOSED LOOP CONTROL

CROSS REFERENCE TO RELATED APPLICATIONS

This application is a divisional of U.S. patent application Ser. No. 16/389,061, filed Apr. 19, 2019, which claims the benefit of U.S. Provisional Patent App. No. 62/667,696, filed May 7, 2018, the entire disclosures of both of which are hereby incorporated by reference as if set forth in their entirety herein.

TECHNICAL FIELD

This disclosure generally relates to fluid dispensing applicators, and more particularly relates to control loops for controlling the operation of a piezoelectric device within the fluid dispensing applicator.

BACKGROUND

Known applicators for dispensing fluid materials such as solder paste, conformal coatings, encapsulants, underfill material, and surface mount adhesives generally operate to dispense small volumes of fluid material onto a substrate by reciprocating a needle. One method of actuating the needle is through a piezoelectric device, which provides a high level of control and quick response to changes in operation. During jetting operation, for example, upon each down stroke, the needle contacts a valve seat to create a distinct, high pressure pulse that jets a small amount of a material from a nozzle of the applicator. The reciprocal movement of the needle must be precise to maintain a jetted dot of material having specific size and shape qualities that suit a particular purpose. However, the size and shape of a jetted dot of material may stray from the intended values over time. This may be in part to material wear, environmental changes, parts replacement, etc. Without accounting for these changes, undesirable fluid patterns may be applied, which can provide an unacceptable end product.

As a result, there is a need for a system that allows for dynamic, continuous, and automatic correction of needle motion to provide for a consistent jetted material dot size and shape.

SUMMARY

An embodiment of the present disclosure is a system for controlling needle motion of a material applicator. The system includes an actuator assembly that contains a piezoelectric device, wherein the actuator assembly is connected to a needle and configured to translate the needle along a vertical direction, and a sensor assembly comprising an emitter for emitting light, where a portion of the actuator assembly or a portion of the needle occludes a portion the light. The sensor assembly also includes a receiver for receiving a non-occluded portion of the light and a sensor holder configured to secure the emitter and the receiver. The system further includes a controller in electrical communication with the piezoelectric device, emitter, and receiver, where the controller is configured to adjust operation of the actuator assembly based on feedback received from the receiver.

Another embodiment of the present disclosure is a method of controlling needle motion of a material applicator that includes an actuator assembly coupled to a needle. The method includes actuating a piezoelectric device of the actuator assembly such that the needle translates along a vertical direction and emitting light from an emitter to a receiver such that a portion of the actuator assembly or a portion of the needle occludes a portion of the light and the receiver receives a non-occluded portion of the light. The method also includes adjusting operation of the piezoelectric device based on feedback received from the receiver.

A further embodiment of the present disclosure is a system for controlling a needle motion of a material applicator. The system includes an actuator assembly that contains a piezoelectric device, where the actuator assembly is connected to a needle and configured to translate the needle along a vertical direction between a first position where the needle is spaced from a valve seat of a nozzle and a second position where the needle contacts the valve seat. Transitioning the needle between the first and second positions jets an amount of the material from the nozzle. The system also includes a sensor assembly having an emitter for emitting light, where a portion of the actuator assembly or a portion of the needle occludes a portion of the light, and a receiver for receiving a non-occluded portion of the light, where the receiver is positioned on an opposite side of the actuator assembly from the emitter. The sensor assembly further has a sensor holder configured to secure the emitter and the receiver. The system also includes a controller in electrical communication with the piezoelectric device, emitter, and receiver, where the controller is configured to operate a feedback loop to adjust a voltage supplied to the piezoelectric device of the actuator assembly based on feedback received from the receiver to maintain a constant size and shape of the material jetted from the nozzle.

BRIEF DESCRIPTION OF THE DRAWINGS

The foregoing summary, as well as the following detailed description, will be better understood when read in conjunction with the appended drawings. The drawings show illustrative embodiments of the disclosure. It should be understood, however, that the application is not limited to the precise arrangements and instrumentalities shown.

DETAILED DESCRIPTION OF ILLUSTRATIVE EMBODIMENTS

Figure 1:
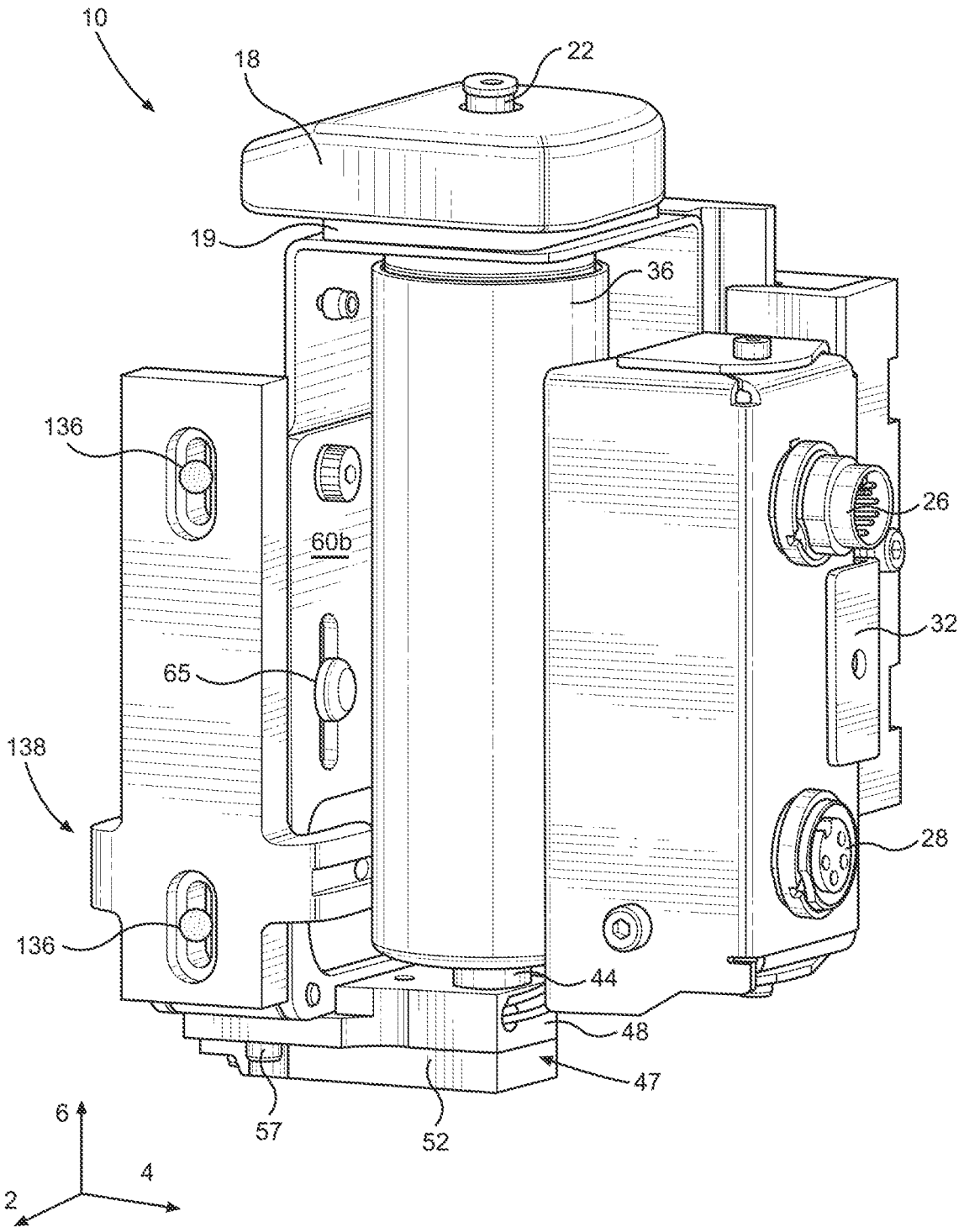
FIG. 1 is a perspective view of an applicator.

An applicator 10 according to an embodiment of the present disclosure includes an actuator assembly 111 that includes a piezoelectric device 112, where the actuator assembly 111 is connected to a needle 76. The applicator 10 also includes a sensor assembly 138 that includes a sensor holder 140 that supports an emitter 154 and a receiver 156, as well as a controller 166 for receiving feedback from the sensor assembly 138. Certain terminology is used to describe the applicator 10 in the following description for convenience only and is not limiting. The words "right," "left," "lower," and "upper" designate directions in the drawings to which reference is made. The words "inner" and "outer" refer to directions toward and away from, respectively, the geometric center of the description to describe the applicator 10 and related parts thereof. The words "forward" and "rearward" refer to directions in a longitudinal direction 2 and a direction opposite the longitudinal direction 2 along the applicator 10 and related parts thereof. The terminology includes the above-listed words, derivatives thereof, and words of similar import.

Unless otherwise specified herein, the terms "longitudinal," "lateral," and "vertical" are used to describe the orthogonal directional components of various components of the applicator 10, as designated by the longitudinal direction 2, lateral direction 4, and vertical direction 6. It should be appreciated that while the longitudinal and lateral directions 2, 4 are illustrated as extending along a horizontal plane, and the vertical direction 6 is illustrated as extending along a vertical plane, the planes that encompass the various directions may differ during use.

Figure 2:
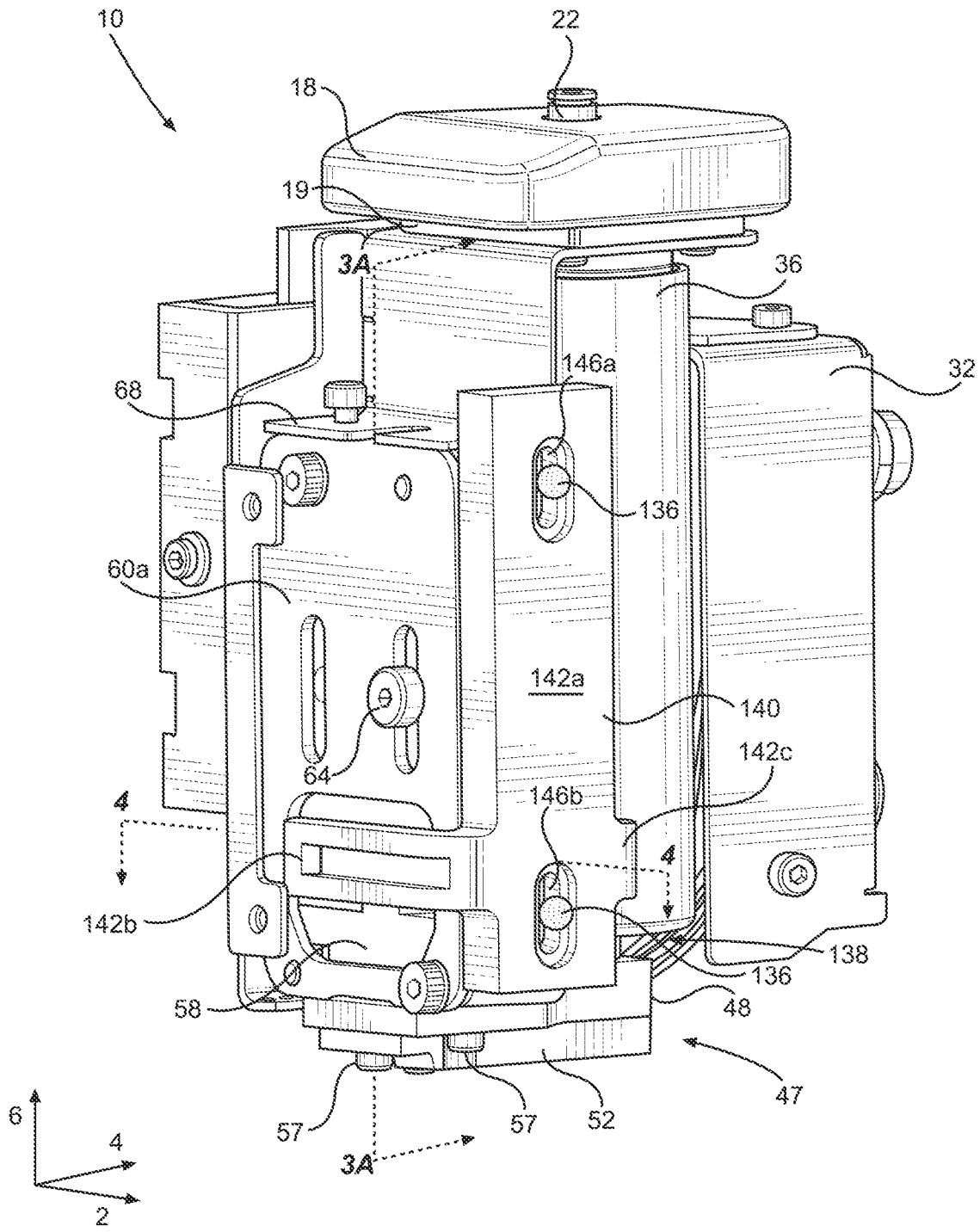
FIG. 2 is an alternative perspective view of the applicator shown in FIG. 1.

Embodiments of the invention include an applicator 10 for apply a material, such as a hot melt adhesive, to a substrate during manufacturing. In particular, the material may be a polyurethane reactive (PUR) hot melt. Referring to FIGS. 1-2, the applicator 10 includes a first connector 26 and a second connector 28. The first connector 26 may define a male connection comprising a plurality of tines, and is configured to connect to a wire (not shown) that connects the first connector 26 to a power source, such that the applicator 10 receives a power input through the first connector 26. The second connector 28 may define a female connection comprising a plurality of recesses, and can be configured to connect to a wire (not shown) that connects the second connector 28 to a controller, such as controller 166, which will be discussed further below, such that information is transmitted to and from the applicator 10 through the second connector 28. The controller may be a general purpose computer, tablet, laptop, smartphone, etc. However, the first and second connectors 26, 28 may be configured as other types of connectors as desired. In other embodiments, the applicator 10 may transmit information to a controller wirelessly via Bluetooth or Wi-Fi. The first and second connectors 26, 28 are configured to be mounted to a circuitry housing 32, which can contain a circuit board (not shown).

The applicator 10 includes a cap 18 that is configured to cover an opening through which material is to be added to the applicator 10. Though in the depicted embodiment the applicator 10 is configured to receive a syringe (not shown) that contains material, it is contemplated that the applicator 10 may receive material through alternative means, such as through filling material directly into the applicator 10 or providing the applicator 10 with an input to an external material source, such as a hopper or melter (not shown). The cap 18 can receive an input connector 22 that extends through the cap 18. The input connector 22 can be configured to interface with an external pressurized air source, which functions to selectively move material through the applicator 10.

The applicator 10 can further include a cap seat 19, which is disposed between the cap 18 and a heater 36. In addition to supporting the cap 18, the cap seat 19 is configured to interact with the cap 18 such that the cap 18 is locked to the cap seat 19 during operation of the applicator 10, in particular when pressurized air is received by the heater 36 through the input connector 22. The cap seat 19 can be releasably coupled to the applicator 10, such that the cap seat 19 secures the heater 36 within the applicator 10 when the cap seat 19 is attached to the applicator 10, and provides an opening for removing the heater 36 from the applicator 10 when the cap seat 19 is detached from the applicator 10. The cap seat 19 can define a channel that extends therethrough and is sized to allow a syringe to pass into the heater 36.

Continuing with FIGS. 1-2, the heater 36 functions to provide heat to the material contained therein, which may be housed within with a syringe. This allows the material to be maintained at a desirable temperature for jetting and flowing through the applicator 10, as well as allows an operator of the applicator 10 to monitor the temperature of the material within the heater 36 to avoid unintentional temperature peaks or dips in temperature of the material. The heater 36 can define a hollow, substantially cylindrical body that is open to the cap seat 19 for receiving the material, around which a heating element (not shown) is disposed. Portions of the heater 36 can be formed of a metal, such as aluminum, though other materials may be included that have sufficient conductivity to allow heat to pass through for heating the material within the heater 36. The heater 36 can also include a temperature sensor (not shown) that is in communication with the controller 166 for monitoring temperature levels within the heater 36.

At the bottom of the heater 36, the heater 36 is supported by a connector 44, which connects the heater 36 to the plate assembly 47. The connector 44 defines a passageway that allows the heated material contained within heater 36 to flow out of the heater 36 and into the plate assembly 47. The plate assembly 47, which is located at the lower end of the applicator 10, provides a pathway for material to flow from the heater 36 to the jetting dispenser assembly 54, which will be described below. The plate assembly 47 can include a plurality of plates, such as a top plate 48 and a bottom plate 52 that are releasably coupled together to form the plate assembly 47. However, the plate assembly 47 can include more than two plates, such as three, four, or more plates as desired. Alternatively, the plate assembly 47 can be replaced with a monolithic block (not shown) that similarly provides a pathway for material to flow from the heater 36 to the jetting dispenser assembly 54. When two plates are included in the plate assembly 47, the passageway through the plate assembly 47 can be defined at least partially by each of the top and bottom plates 48, 52. The top and bottom plates 48, 52 can be configured to receive a seal 86 at their interface that surrounds the passageway through the plate assembly 47 and prevent material from exiting the passageway.

When the plate assembly 47 is fully assembled, the bottom surface of the top plate 48 may contact the top surface of the bottom plate 52, such that the top plate 48 is disposed above the bottom plate 52 along the vertical direction 6. The top plate 48 can be releasably coupled to a housing 58 through a plurality of threaded fasteners 57 that extend through the top plate 48 and engage the housing 58. However, other methods of releasably coupling the top and bottom plates 48 and 52 are contemplated. For example, the top and bottom plates 48, 52 may be coupled by snap fit engagement, dovetail slot structure, etc. The plate assembly 47 may comprise a heating block, such that the top and bottom plates 48 and 52 are configured to heat material that passes through the plate assembly 47, thus ensuring that the material maintains optimal qualities for flow and dispensing.

Now referring to FIGS. 3A-3B, the jetting dispenser assembly 54 will be described in greater detail. Components of the jetting dispenser assembly 54 can be received within a chamber 72 that is at least partially defined by each of the top and bottom plates 48, 52 of the plate assembly 47. The jetting dispenser assembly 54 can include a nozzle 56 that defines a valve seat 80 and a discharge passageway 82 that extends from the chamber 72 to the to the exterior of the applicator 10. The discharge passageway 82 is the conduit by which material exits the applicator 10 and is applied to a substrate. The jetting dispenser assembly 54 further includes a needle 76 that extends through and is movable within the chamber 72. The needle 76 defines a needle tip 76*a* and a needle stem 76*b* that extends away from the needle tip 76*a* along the vertical direction 6. The needle tip 76*a* can be configured to engage the valve seat 80 to form a seal, such that when the needle tip 76*a* engages the valve seat 80, material is prevented from flowing through the discharge passageway 82. As such, the needle 76 is moveable within the chamber 72 between a first position and a second position along the vertical direction 6. In the first position, the needle tip 76*a* is spaced form the valve seat 80 along the vertical direction 6, which allows the material to access the discharge passageway 82. In the second position, the needle tip 76*a* engages the valve seat 80, thus preventing material from entering the discharge passageway 82. In a jetting dispenser assembly 54 such as the one depicted, actuation of the needle from the first position to the second position causes the needle tip 76*a* to jet an amount of material through the discharge passageway 82. This jetting motion can be repeated rapidly, which allows for discrete dots of material having a predetermined size and shape to be applied to a substrate. The needle tip 76*a* and the valve seat 80 may be configured to have complementary shapes to prevent material leakage. In one embodiment, the needle tip 76*a* and the valve seat 80 may comprise complementary hemispherical shapes. Alternatively, the needle tip 76*a* and the valve seat 80 may comprise complementary flat shapes. The mechanism by which the needle 76 is actuated between the first and second positions will be described further below.

The jetting dispenser assembly 54 further includes a seal pack 90 that is configured to be received within the chamber 72. Specifically, the seal pack 90 divides the chamber into two sections—a first section that is below the seal pack 90 along the vertical direction 6, and a second section that is above the seal pack 90 along the vertical direction 6. The seal pack 90 defines a ledge 94 that is configured to engage the top surface of the bottom plate 52, which vertically positions the seal pack 90 within the chamber 72. The seal pack 90 also defines a seal pack passageway 95 that extends through the seal pack 90 along the vertical direction 6. The seal pack passageway 95 is configured to receive the needle stem 76*b*, such that the needle 76 extends through the second section 72*b* of the chamber 72, through the seal pack 90, and into the first section 72*a* of the chamber 72. The seal pack 90 may house a seal 96 within the seal pack passageway 95 that substantially surrounds the needle stem 76*b*. The seal 96 may function to prevent material from flowing from the first section 72*a* of the chamber 72 into the second section 72*b* through the seal pack passageway 95. Additionally, the jetting dispenser assembly 54 can include a seal 98 disposed around the seal pack 90 between the seal pack 90 and the top plate 48 of the plate assembly 47. The seal 98 can prevent material from flowing from the top plate 48 to the gap between the top plate 48 and the housing 58. Alternatively, the seal 98 can be disposed around the seal pack 90 between the seal pack 90 and the bottom plate 52. As such, the seals 96 and 98 aid in keeping the material within the first section 72*a* of the chamber 72 after the material exits the passageway defined by the plate assembly 47.

Further, the jetting dispenser assembly 54 includes a spring 104 disposed within the second section 72*b* of the chamber 72. The spring 104 is disposed between a portion of the housing 58 that bounds the second section 72*b* of the chamber 72 and a ledge 100 defined by the needle 76. The spring 104 may be placed within the jetting dispenser assembly 54 in a naturally compressed state, such that the spring 104 constantly applies a downward force to the ledge 100. This downward force on the ledge 100 of the needle 76 biases the needle 76 downward along the vertical direction 6. As such, the spring 104 naturally biases the needle 76 into the second position, such that an upward force on the needle 76 is required to displace the needle tip 76*a* from the valve seat 80, and thus transition the needle 76 from the second position to the first position.

Figure 3A:
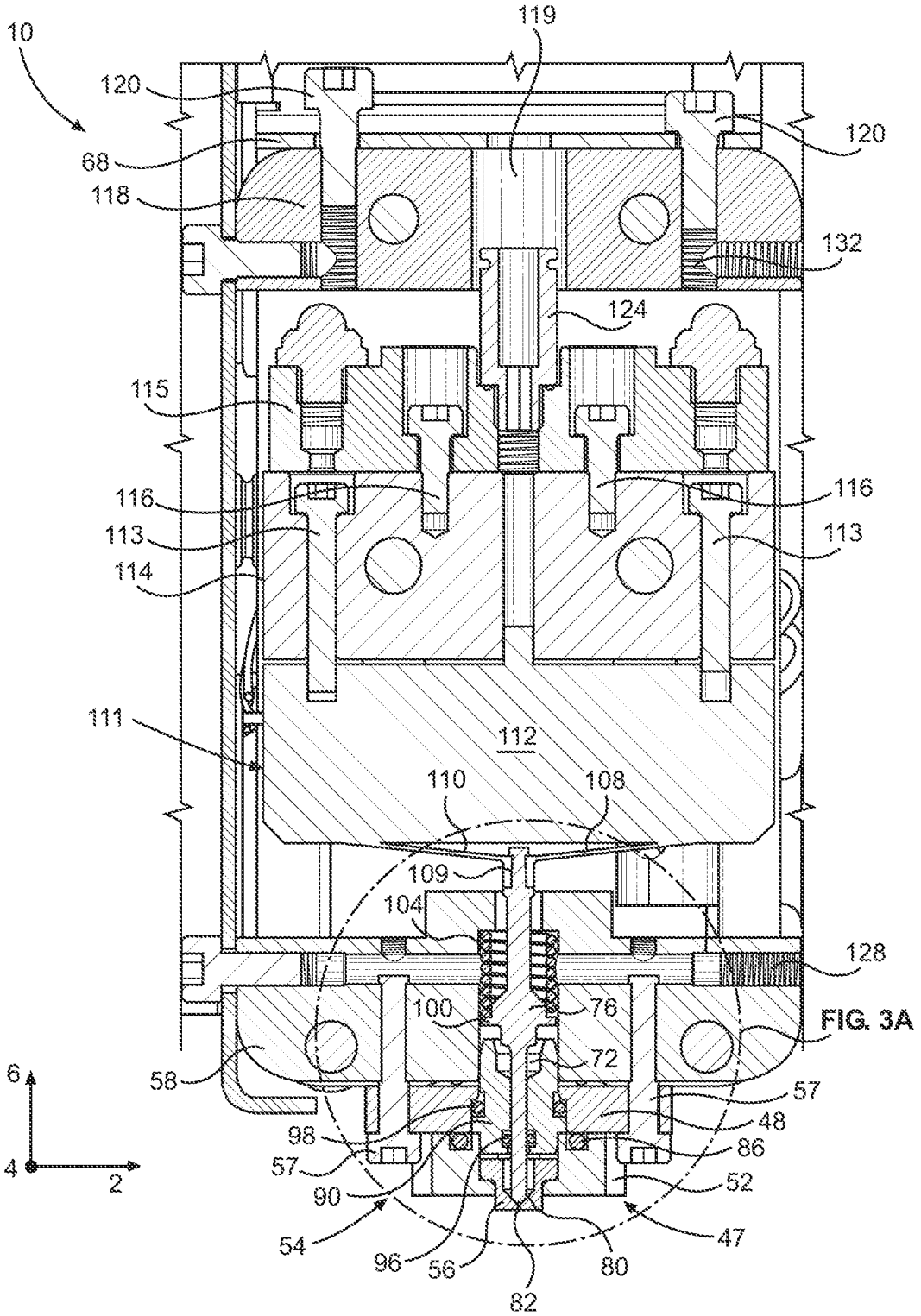
FIG. 3A is a cross-sectional view of the applicator shown in FIG. 1, taken along line 3A-3A shown in FIG. 2.
Figure 3B:
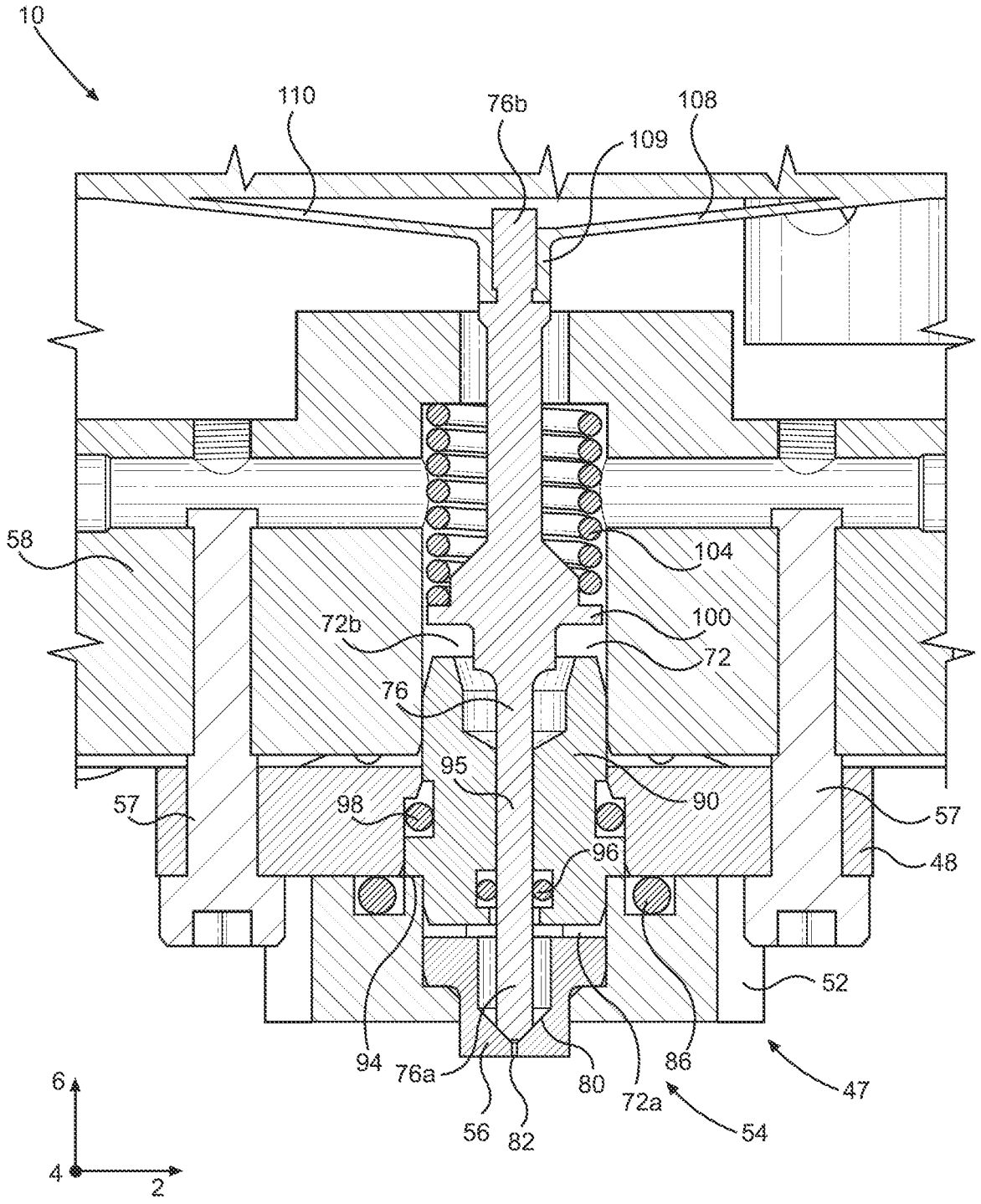
FIG. 3B is an enlarged view of the encircled region of the applicator shown in FIG. 3A.

Continuing with FIGS. 3A-3B, the jetting dispenser assembly 54 also includes an actuator assembly 111 operatively coupled to the needle 76. The actuator assembly 111 can include a piezoelectric device 112 and a pair of movable actuator arms 108, 110. The actuator arms 108, 110 may extend diagonally from respective corners of the piezoelectric device 112 in a direction towards each other and the top end of the needle stem 76*b*. A connector 109 is configured to connect the pair of actuator arms 108, 110 together, as well as secure the actuator arms 108, 110 to the upper end of the needle stem 76*b*. The connector 109 can secure the needle stem 76*b* through a pair of locking tabs that project radially inwards towards each other, though other means of attachment are contemplated. For example, the connector 109 and the needle stem 76*b* can be releasably attached through a threaded engagement.

The piezoelectric device 112 is configured to translate the needle 76 between the first and second positions. The actuator assembly 111 is coupled to controller 166 external to the actuator that controls operation of the piezoelectric device 112. The controller 166 will be described further below. The actuator assembly 111 is also coupled to a power source (not shown) that provides power to the piezoelectric device. As noted above, the needle 76 is in a neutral position in the second position, such that the needle tip 76*a* engages the valve seat 80. To transition the needle 76 to the first position, the controller directs the power source to provide a positive charge to the piezoelectric device 112. This positive charge causes the piezoelectric device 112, which may include a piezoelectric stack, to expand, which pulls the actuator arms 108, 110 toward the piezoelectric device 112. Thus, the actuator arms 108, 110 and the needle 76 are pulled toward the piezoelectric device 112, causing the needle tip 76*a* to draw away from the valve seat 80. When the controller 166 directs the power source to cease providing the positive charge to the piezoelectric device 112, the piezoelectric device 112 retracts, which pushes the actuator arms 108, 110 away from the piezoelectric device 112. This retraction of the piezoelectric device 112, along with the force applied by the spring 104 to the ledge 100 of the needle 76, forces the needle 76 downward such that the needle tip 76*a* impacts the valve seat 80. When the needle tip 76*a* impacts the valve seat 80, material is jetted through the discharge passageway 82 of the nozzle 56.

Referring to FIGS. 1-3B, the piezoelectric device 112 can be connected to a lower block 114 through fasteners 113, and the lower block 114 can be connected to an upper block 115 through fasteners 116. Collectively, the piezoelectric device 112, lower block 114, and upper block 115 can comprise the actuator assembly 111. The actuator assembly 111 can be disposed between first and second plates 60*a*, 60*b*, which can be spaced apart along the lateral direction 4. The first and second plates 60*a*, 60*b* may each define at least one slot that is configured to allow a fastener 64 to extend through. The fastener 64 can extend through the slot of the first plate 60*a*, through the lower block 114, through a corresponding slot of the second plate 60*b*, and engage a nut 65, which is disposed adjacent to plate 60*b*. The fastener 64 can be threaded to engage the nut 65, such that the fasteners 64 and nut 65 can be loosened from and tightened to the first and second plates 60*a*, 60*b*, respectively. Loosening the fastener 64 and nut 65 from the plates 60*a*, 60*b* allows movement of the actuator assembly 111 along the vertical direction 6 relative to other components of the applicator 10. Adjusting the position of the actuator assembly 111 adjusts the initial position of the needle 76, thus changing the stroke length of the needle 76, which is defined as the distance the needle 76 travels between the first position and the second position. The ability to adjust the initial position and the stroke length of the needle 76 allows the applicator 10 to have flexibility in types of material that can be jetted form the jetting dispenser assembly 54 and the types of jetting operations the applicator 10 can perform. Once the position of the actuator assembly 111 has been adjusted, the fastener 64 and nut 65 can be tightened to the plates 60*a*, 60*b*, such that the actuator assembly 111 is locked in position. Though only one fastener 64 and nut 65 are shown, the applicator 10 can include a plurality of fasteners and corresponding nuts to further aid in adjustment of the actuator assembly 111.

Continuing with FIG. 3A, the applicator 10 includes a stop 118 disposed above the upper block 115 along the vertical direction 6. The stop 118, which is positioned between the first and second plates 60*a*, 60*b*, can be affixed to a plate 68 via fasteners 120. The plate 68 can also be affixed to any combination of the plates 60*a*, 60*b* as well. The stop 118 can define a central channel 119 that is configured to receive a connector 124 that is attached to the upper block 115. The connector 124 can receive pressurized air from an external source (not shown) for reducing heat buildup around the actuator assembly 111.

Figure 4:
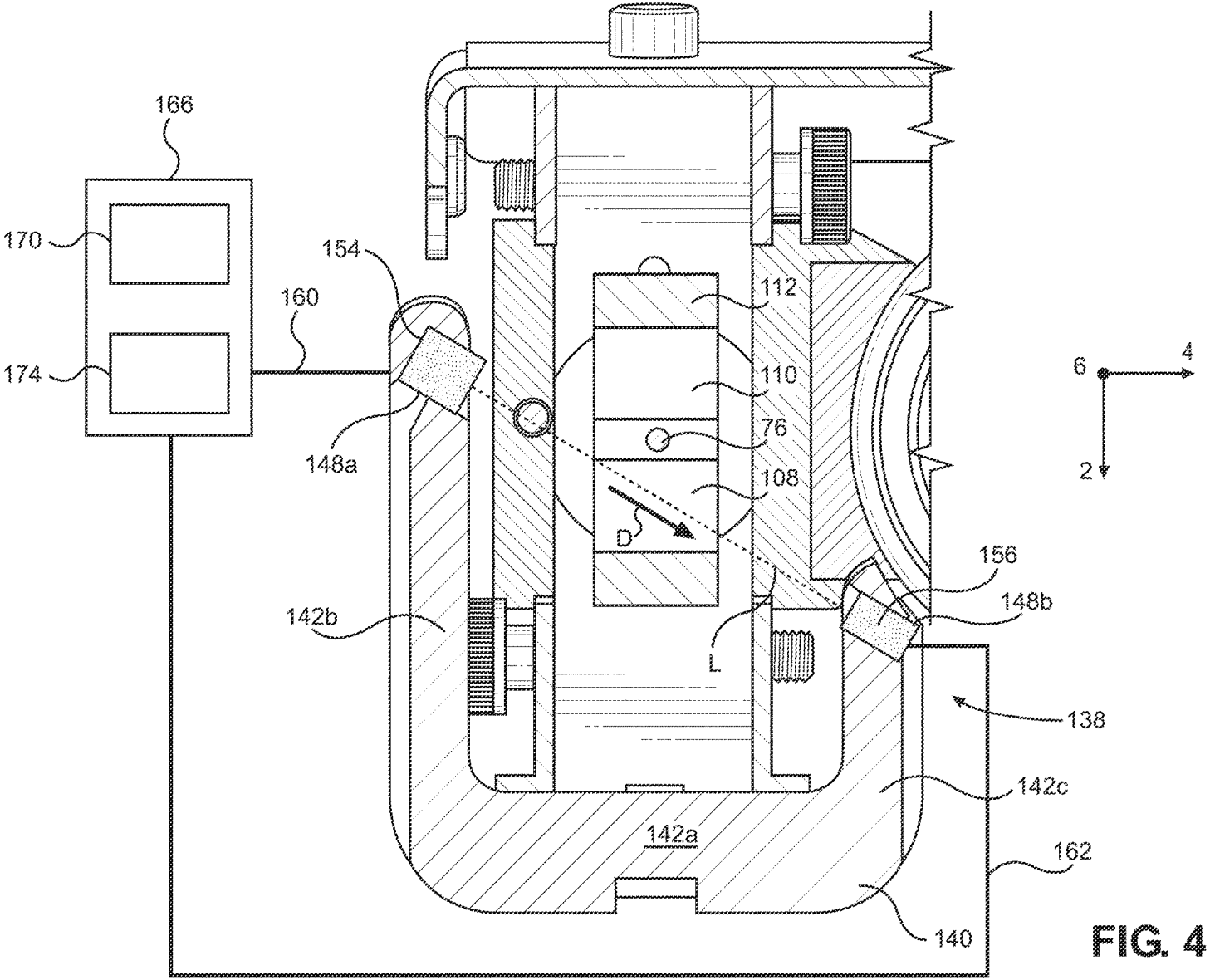
FIG. 4 is a cross-sectional view of the applicator shown in FIG. 1, taken along line 4-4 shown in FIG. 2.

Now referring to FIGS. 1, 2, and 4, the applicator 10 includes a sensor assembly 138 for measure a position and/or velocity of a portion of the actuator assembly 111. The sensor assembly 138 includes a sensor holder 140 that defines a vertically-extending central body portion 142*a* positioned adjacent the actuator assembly 111 along the longitudinal direction 2. The sensor holder 140 can also define a first arm 142*b* that extends from the central body portion 142*a* along the longitudinal direction 2 and a second arm 142*c* that also extends from the central body portion 142*a* along the longitudinal direction 2. The first and second arms 142*b*, 142*c* can be spaced apart along the lateral direction 4 on opposite sides of the actuator assembly 111, and can be vertically aligned with at least a portion of the actuator assembly 111. Though depicted as being located in a particular vertical position, the sensor assembly 138 can be adjusted upwards and downwards along the vertical direction 6 in relation to other components of the applicator 10. To this end, the central body portion 142*a* of the sensor holder 140 defines a first slot 146*a* positioned at an upper end of the central body portion 142*a* and a second slot 146*b* positioned opposite the first slot 146*a* at a lower end of the central body portion 142*a*. Each of the first and second slots 146*a*, 146*b* can be configured as substantially cylindrical slots, though other shapes are contemplated. Additionally, though only two slots are shown, the central body portion 142*a* can define more or less slots as desired. For example, the central body portion 142*a* can define only one slot, or can define three or more slots.

The first slot 146*a* of the sensor holder 140 can align with a bore 132 that extends into the stop 118 along the longitudinal direction, while the second slot 146*b* can align with a bore 128 that extends into the housing 58 along the longitudinal direction 2. Each of the bores 128, 132 can be configured to receive a corresponding fastener 136. For example, a fastener 136 can extend through the first slot 146*a* and into the bore 132, while another fastener 136 can extend through the second slot 146*b* and engage the bore 128. Each of the fasteners 136, as well as the bores 128, 132, can be at least partially threaded to permit threaded engagement between each of the fasteners 136 and the corresponding one of the bores 128, 132. Though each of the fasteners 136 is depicted as being the same, the fasteners 136, and likewise the first and second slots 146*a*, 146*b* can be differently configured as desired.

In operation, the sensor holder 140 can be attached to the other components of the applicator 10 by aligning the first slot 146*a* with the bore 132 and the second slot 146*b* with the bore 128. Then, a fastener 136 can be inserted through the first slot 146*a* and engaged with the bore 132, while another fastener 136 can be inserted through the second slot 146*b* and engaged with the bore 128. Each of the fasteners 136 can then be sufficiently tightened such that the compressive force imparted on the sensor holder 140 by the fasteners 136, stop 118, and housing 58 locks the sensor assembly 138 relative to the other components of the applicator 10. To adjust the position of the sensor assembly 138 along the vertical direction 6, the upper fastener 136 can be sufficiently loosened from the bore 132 and the lower fastener 136 can be sufficiently loosened from the bore 128 such that the fasteners still extend through the first and second slots 146*a*, 146*b*, and engage the bores 132 and 128, respectively, but the sensor holder 140 is capable of moving along the vertical direction 6. The sensor holder 140 can thus be moved along the vertical direction 6 to a desired position. However, the fasteners 136 still extending through the first and second slots 146*a*, 146*b* limits the range of motion the sensor holder 140 is capable of, such as only along the vertical direction 6. Once the sensor holder 140 is in the desired position, the fasteners 136 can again be sufficiently tightened against the sensor holder 140 so that the sensor holder 140 is again affixed relative to the other components of the applicator 10.

Now referring to FIG. 4, the first arm 142*b* of the sensor holder 142 defines a first bore 148*a*, while the second arm 142*c* of the sensor holder 142 defines a second bore 148*b*. The first and second bores 148*a*, 148*b*, are thus positioned on opposite sides of the actuator assembly 111, but can be oriented such that they are aligned and face each other along a direction D. As depicted, the direction D lies along a plane defined by the longitudinal and lateral directions 2, 4 and is normal to the vertical direction 6, which further results in the direction D being perpendicular to the direction of motion of the needle 76 as it transitions between the first and second positions. Additionally, the direction D is depicted as angularly offset from both the longitudinal and lateral directions 2, 4. However, the direction D can be alternatively configured as extending in any direction within the plane defined by the longitudinal and lateral directions 2, 4, or even angularly offset from this plane such that the direction D defines a component along the vertical direction 6.

The first bore 148*a* can be sized so as to receive one of an emitter 154 or a receiver 156, while the second bore 148*b* can also be sized so as to receive one of an emitter 154 or a receiver 156. In the depicted embodiment, the emitter 154 is shown as secured to the sensor holder 140 within the first bore 148*a*, while the receiver 156 is shown as secured to the sensor holder 140 within the second bore 148*b*, though it is contemplated that this arrangement can be reversed. Regardless of which of the first and second bores 148*a*, 148*b* the emitter 154 and receiver 156 are respectively received in, in the depicted embodiment the emitter 154 and receiver 156 are shown as being positioned on opposite sides of the actuator assembly 111. In operation, the emitter 154 can be configured to emit light L, and the receiver 156 can be configured to receive at least a portion of the light L emitted by the emitter 154. The emitter 154 can be any emitter capable of emitting light, such as an LED, or more specifically can be an emitter capable of emitting light in the infrared spectrum. The receiver 156 can be any type of receiver that can be tuned to receive light having the wavelength emitted by the corresponding emitter 154. As the emitter 154 and receiver 156 are aligned along the direction D, light L emitted by the emitter 154 can be at least partially occluded by a portion of the actuator assembly 111 at any particular time, depending on the position of the actuator assembly 111 and the given position of the needle 76 within a jetting cycle. The receiver 156 then receives the non-occluded portion of the light. Alternatively, the light L emitted by the emitter 154 can be at least partially occluded by a portion of the needle 76.

Though the sensor assembly 138 is depicted such that the sensor holder 140 defines two arms 142*b*, 142*c*, where the first arm 142*b* supports the emitter 154 and the second arm 142*c* supports the receiver 156, alternative embodiments are contemplated. In one embodiment, both the emitter 154 and receiver 156 can be secured to one of the first and second arms 142*b*, 142*c*, such that both the emitter 154 and the receiver 156 face the same side of the actuator assembly 111. As a result, the sensor holder 140 may only include one of the first and second arms 142*b*, 142*c* in this embodiment (not shown). In operation, in this embodiment the emitter 154 can emit light L, which can interact with a portion of the actuator assembly 111 or needle 76 and received at least in part by the receiver 156. However, rather than receiving the portion of the light L not occluded by the actuator assembly 111 or the needle 76, in this embodiment the receiver 156 will receive the portion of the light L reflected by the component with which it interacts.

Figure 5A:
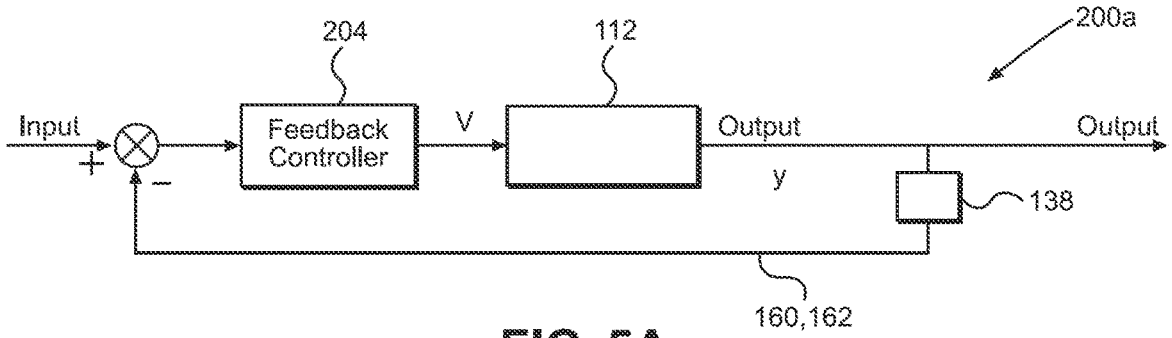
FIG. 5A is a diagram illustrating an embodiment of a control loop for controlling a piezoelectric device of an applicator.
Figure 5B:
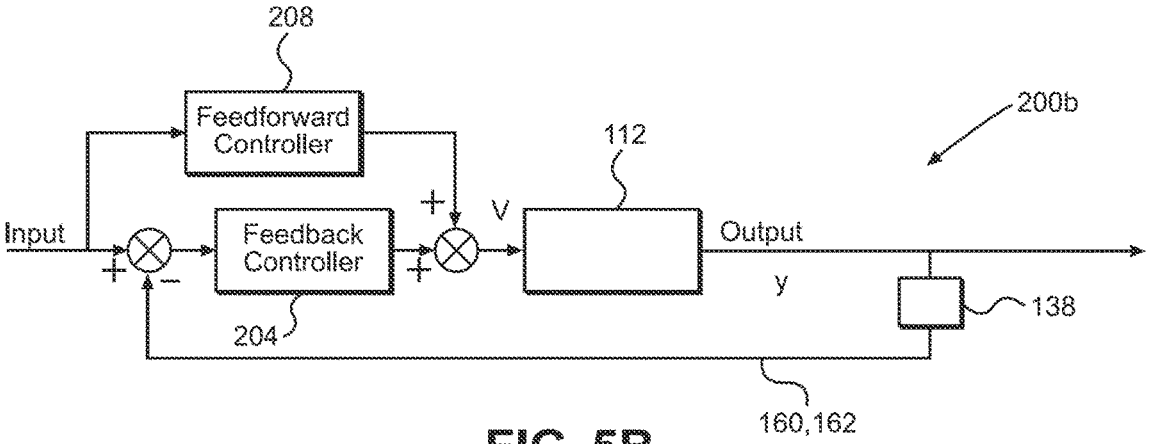
FIG. 5B is a diagram illustrating another embodiment of a control loop for controlling a piezoelectric device of an applicator.
Figure 5C:
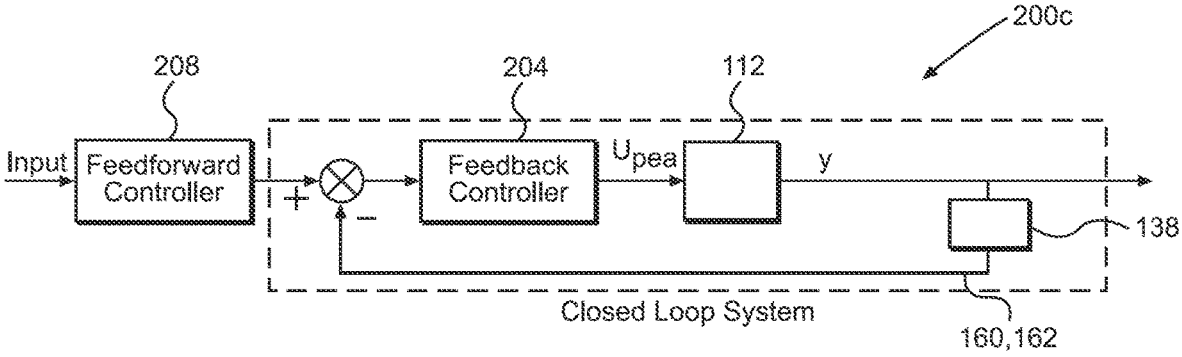
FIG. 5C is a diagram illustrating a further embodiment of a control loop for controlling a piezoelectric device of an applicator according to an embodiment of the present disclosure.

Now referring to FIGS. 4-5C, the applicator 10 includes a controller 166 coupled to the emitter 154 and the receiver 156 through connections 160, 162, respectively. The controller 166 can comprise any suitable computing device configured to host a software application for monitoring and controlling various operations of the applicator 10 as described herein. It will be understood that the controller 166 can include any appropriate computing device, examples of which include a processor, a desktop computing device, a server computing device, or a portable computing device, such as a laptop, tablet, or smart phone. Specifically, the controller can include a memory 170 and an HMI device 174. The memory 170 can be volatile (such as some types of RAM), non-volatile (such as ROM, flash memory, etc.), or a combination thereof. The controller 166 can include additional storage (e.g., removable storage and/or non-removable storage) including, but not limited to, tape, flash memory, smart cards, CD-ROM, digital versatile disks (DVD) or other optical storage, magnetic tape, magnetic disk storage or other magnetic storage devices, universal serial bus (USB) compatible memory, or any other medium which can be used to store information and which can be accessed by the controller 166. The HMI device 174 can include inputs that provide the ability to control the controller 166, via, for example, buttons, soft keys, a mouse, voice actuated controls, a touch screen, movement of the controller 166, visual cues (e.g., moving a hand in front of a camera on the controller 166), or the like. The HMI device 174 can provide outputs, via a graphical user interface, including visual information, such as the visual indication of the current position and velocity values of the needle 76, as well as acceptable ranges for these parameters via a display. Other outputs can include audio information (e.g., via speaker), mechanically (e.g., via a vibrating mechanism), or a combination thereof. In various configurations, the HMI device 174 can include a display, a touch screen, a keyboard, a mouse, a motion detector, a speaker, a microphone, a camera, or any combination thereof. The HMI device 174 can further include any suitable device for inputting biometric information, such as, for example, fingerprint information, retinal information, voice information, and/or facial characteristic information, for instance, so as to require specific biometric information for access the controller 166.

The controller 166 can control the emission of light L from the emitter 154 by transmitting instructions to the emitter 154 through the connection 160, as well as receive a signal from the receiver 156 indicative of the portion of the light L received by the receiver 156 through the connection 162. Each of the connections 160, 162 can be a wired connection or wireless connection. Examples of suitable wireless connections include ZigBee, Z-wave, Bluetooth, Wi-Fi, or radio wave. The portion of the light L received by the receiver 156 can comprise feedback into a control loop implemented by the controller 166, which will be discussed further below. The controller 166 can use the information about the light L received from the receiver 156, which can also be referred to as feedback, to determine a position of the needle 76 at a discrete moment in time. The controller 166 can also use the information about the light L received from the receiver 156 to determine a velocity of the needle 76 at a discrete moment in time. The controller 166, in addition to being in signal communication with the emitter 154 and the receiver 156, can also be in signal communication with the piezoelectric device 112 of the actuator assembly 111. In response to receiving the feedback from the receiver 156, the controller 166 can adjust the operation of the actuator assembly 111 using one of the control loops 200*a*-200*c* described below to maintain a desired jetted material dot size and shape.

The controller 166 is configured to implement a control loop to control the operation of the actuator assembly 111, and thus the movement of the needle 76 between the first and second positions. To achieve this, the control loop can comprise one of the control loops 200*a*-200*c* (FIGS. 5A-5C). The input into the control loops 200*a*-200*c* can be a desired voltage waveform provided to the piezoelectric device 112 of the actuator assembly 111. The memory 170 can be configured to store a variety of voltage waveforms, each of which has a predetermined relation to a particular motion pattern or velocity of the needle 76 and a particular dot size and/or shape. The particular voltage waveform provided to a particular one of the control loops 200*a*-200*c* can be recalled from the memory 170 in response to a particular input into the HMI device 174. The input provided to the HMI device 174 can be a desired jetting motion of the needle 76, a specific jetting operation, a particular fluid or substrate to be utilized, a particular jetted dot size and shape, initial voltage values to provide to the piezoelectric device 112, a voltage rate at which to apply voltage to the piezoelectric device 112, etc. Each of these inputs, as well as others, can be correlated to a specific voltage waveform stored in the memory 170, which can be automatically recalled and inputted into one of the control loops 200*a*-200*c* upon receiving the corresponding input. Likewise, the outputs of each of the control loops 200*a*-200*c* is an adjustment to the voltage or voltage rate provided to the piezoelectric device 112 in order to achieve the desired needle motion, which is in part determined from the feedback received from the sensor assembly 138.

FIG. 5A shows one embodiment of a control loop 200*a* that can be implemented by the controller 166. Control loop 200*a* embodies a typical feedback controller. The control loop 200*a* receives an input that can take the form of a desired voltage waveform, as described above. However, this input only partially comprises the complete input provided to the control loop 200*a*. In addition to the desired voltage waveform, the control loop 200*a* incorporates the feedback received from the sensor assembly 138, particularly the receiver 156, into the input. This complete input is then provided to a feedback controller 204, which compares the feedback received from the receiver 156 and the intended position or velocity of the needle 76 based on the input embodying the desired waveform, and produces an output that is an adjustment to the voltage or voltage rate provided to the piezoelectric device 112 to achieve the desired voltage waveform, and thus the desired motion of the needle 76. This feedback controller 204 can calculate this adjustment with reference to a variety of predetermined relations between voltage provided to the piezoelectric device 112 and velocity or position of the needle 76 that are stored in the memory 170.

FIG. 5B shows another embodiment of a control loop 200*b* that can be implemented by the controller 166. Control loop 200*b* embodies a combination of feedback and feedforward control. The control loop 200*a* receives an input that can take the form of a desired waveform, which is subsequently incorporated with feedback received from the receiver 156 of the sensor assembly 138 and provided to the feedback controller 204. Like the control loop 200*a*, the feedback controller 204 compares the feedback received from the receiver 156 and the intended position or velocity of the needle 76 based on the input embodying the desired waveform, and produces an output that is an adjustment to the voltage or voltage rate provided to the piezoelectric device 112 to achieve the desired voltage waveform, and thus the desired motion of the needle 76. This feedback controller 204 can calculate this adjustment with reference to a variety of predetermined relations between voltage provided to the piezoelectric device 112 and velocity or position of the needle 76 that are stored in the memory 170. However, the control loop 200*b* also includes a feedforward controller 208 that can receive the input of the desired waveform, and produce an output that is an adjustment to the voltage or voltage rate provided to the piezoelectric device 112 that bypasses the feedback controller 204 and is combined with the output of the feedback controller 204. This use of the feedforward controller 208 can aid in anticipating and minimizing disturbances in the movement of the needle 76 due to the adjustment output produced by the feedback controller 204.

FIG. 5C shows a third embodiment of a control loop 200*c* that can be implemented by the controller 166. Control loop 200*c* embodies an alternative combination of feedback and feedforward control. The control loop 200*b* receives an input that can take the form of a desired waveform, which is subsequently provided as an input to the feedforward controller 208. The feedforward controller 208 then provides an output, which is combined with the feedback received from the receiver 156 of the sensor assembly 138 to form an input provided to the feedback controller 204. The feedback controller 204 then compares the feedback received from the receiver 156 and the output from the feedforward controller 208, and produces an output that is an adjustment to the voltage or voltage rate provided to the piezoelectric device 112 to achieve the desired voltage waveform, and thus the desired motion of the needle 76. This feedback controller 204 can calculate this adjustment with reference to a variety of predetermined relations between voltage provided to the piezoelectric device 112 and velocity or position of the needle 76 that are stored in the memory 170. This use of the feedforward controller 208 provides an alternative method for anticipating and minimizing disturbances in the movement of the needle 76 due to the adjustments caused by the feedback controller 204.

This control loop 200*a* can be implemented on a continuous basis to continuously monitor and adjust the movement of the needle 76 throughout a jetting cycle. With respect to a velocity of the needle 76, the controller 166 can be programmed such that any of the control loops 200*a*-200*c* decreases the voltage or voltage rate supplied to the piezoelectric device 112 when the velocity of the needle 76 is above a predetermined threshold, or alternatively increase the voltage or voltage rate supplied to the piezoelectric device 112 when the velocity of the needle 76 is below a predetermined threshold. The controller 166 can be programmed such that there is an acceptable range of needle velocities, and that the voltage rate supplied to the piezoelectric device 112 is maintained when the velocity of the needle 76 is within the acceptable range. The acceptable ranges and/or predetermined thresholds can be provided to the controller 166 by a user through the HMI device 174 or recalled from the memory 170.

Figure 6:
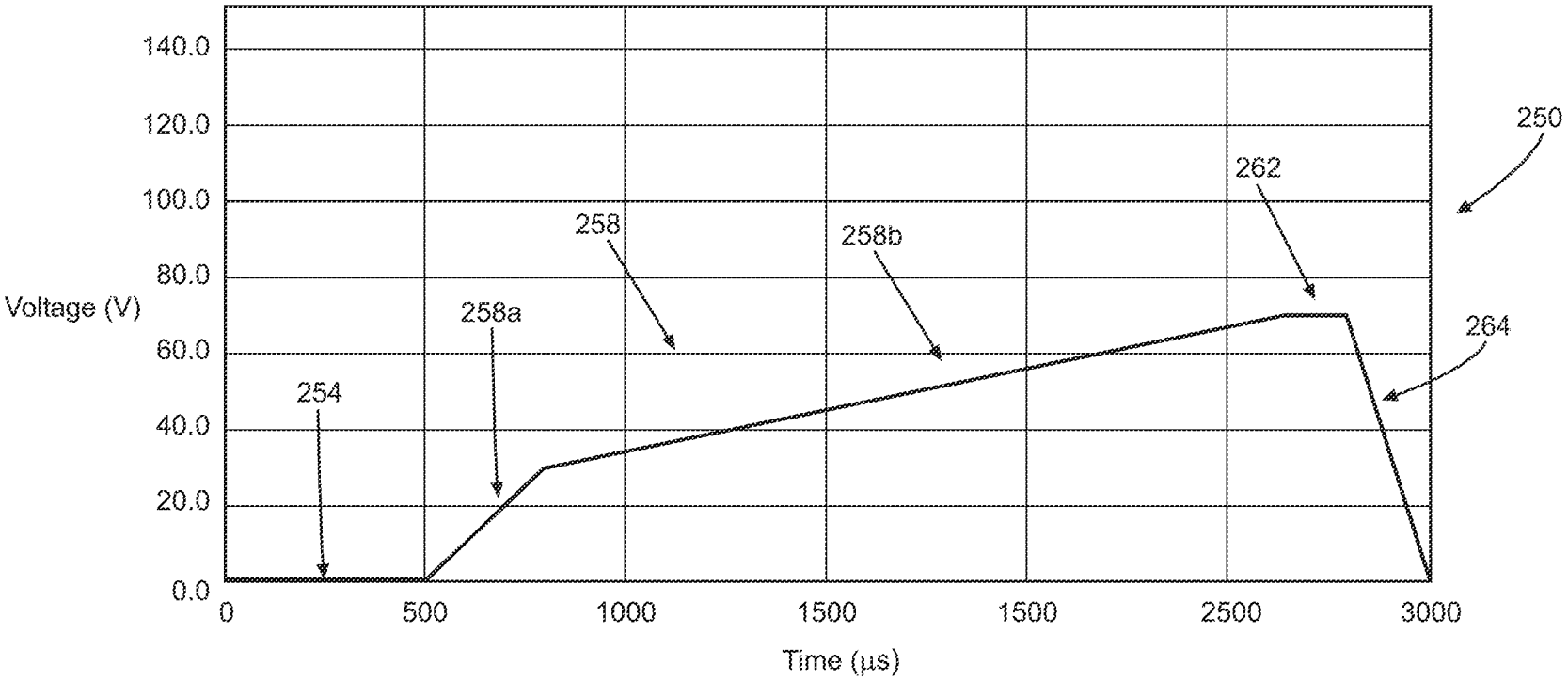
FIG. 6 is a plot of a voltage waveform provided to a piezoelectric device of the applicator shown in FIG. 1 over time.

Now referring to FIG. 6, a plot of an exemplary voltage waveform 250 provided to the piezoelectric device 112 of the actuator assembly 111 to transition the needle 76 from the second position, to the first position, and back to the second position over a period of time is depicted. As shown, the voltage waveform 250 may not be sinusoidal, but may rather take on a somewhat sawtooth shape. This is because a sharp drop in the needle 76 is required when transitioning the needle 76 from the first position to the second position so that a discrete amount of material having a desired shape and size is jetted from the nozzle 56. As depicted, the voltage waveform 250 has several discrete sections. In baseline portion 254, no voltage is being supplied to the piezoelectric device 112 between 0 and 500 microseconds. At 500 microseconds, an increasing portion 258*a* of the voltage waveform 250 begins. This increasing portion 258 of the voltage waveform 250 continues from 500 microseconds to about 2700 microseconds, and defines a portion of the voltage waveform 250 during with the voltage supplied to the piezoelectric device 112 continuously increases. This increase in voltage causes the piezoelectric device 112 to expand, thus drawing the needle 76 away from the nozzle 56. As depicted, the increasing portion 258 includes first and second portions 258*a*, 258*b*. During the first portion 258*a*, the voltage level increases quicker than in in the second portion 258*b*. As a result, the needle 76 is drawn away from the nozzle 56 quicker during the beginning of the piezoelectric device 112 receiving the increasing portion 258 of the voltage waveform 250 than at the end. Though the increasing portion 258 of the voltage waveform 250 is shown as having two sections of differing voltage increase speed, more or less sections are contemplated.

After the increasing portion 258 of the voltage waveform 250, voltage is supplied to the piezoelectric device 112 at a constant voltage from about 2700 to about 2800 microseconds. This constant portion 262 of the voltage waveform represents the time that the needle 76 is retracted completely into the first position, and is referred to as the dwell. Adjusting the dwell position of the needle 76 by adjusting the voltage applied to the piezoelectric device 112 during the constant portion 262 of the waveform using one of the control loops 200*a*-200*c* can aid in controlling the shape and size of the dot of material jetted from the nozzle 56. After the constant portion 262, the voltage applied to the piezoelectric device 112 quickly drops to zero during the decreasing portion 264. This quick drop in voltage supplied to the piezoelectric device 112 during the decreasing portion 264 of the voltage waveform 250 causes a quick contraction of the piezoelectric device 112, thus quickly driving the needle 76 towards the nozzle 56 until the needle 76 strikes the valve seat 80. This causes a dot of material having a predetermined size and shape to be jetted from the nozzle 56 of the applicator 10 onto a substrate. By altering the speed at which the voltage decreases during the decreasing portion 264 of the voltage waveform 250 using one of the control loops 200*a*-200*c*, the dot size and shape of the material jetted from the applicator 10 can be further controlled.

Figure 7:
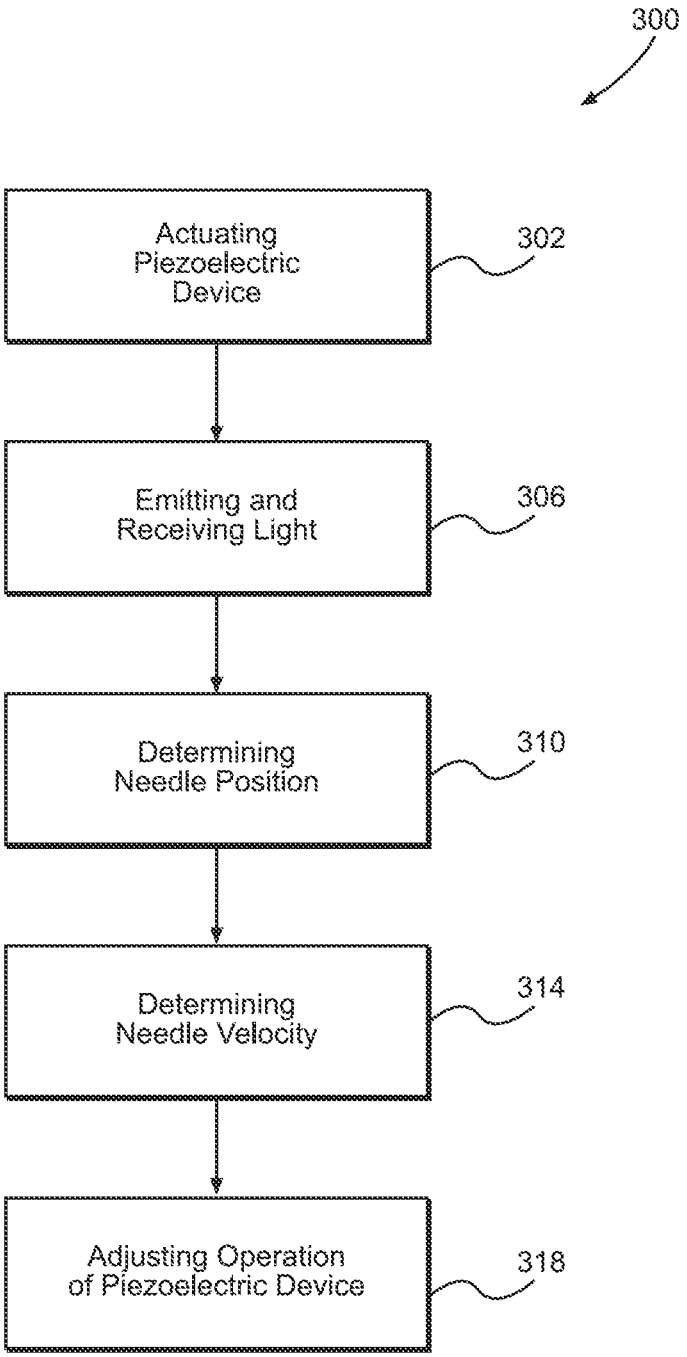
FIG. 7 is a process flow diagram of a method of controlling needle motion of an applicator.

Continuing with FIG. 7, a method 300 for controlling the motion of the needle 76 using the sensor assembly 138 and connected controller 166 to maintain a predetermined material dot size and shape will be discussed. The method 300 includes first actuating the piezoelectric device 112 of the actuator assembly 111 in step 302. By actuating the piezoelectric device 112, the needle 76 translates along the vertical direction 6 between the first and second position, as described above. This reciprocal movement functions to jet an amount of material from the nozzle 56. In step 306, which can be initiated before, during, or after performing step 302, the controller 166 can initiate the emitting of light L from the emitter 154 to the receiver 156, such that a portion of the actuator assembly 111 or the needle 76 interacts with the light L. As noted above, the light L can be emitted along a direction D that is perpendicular to the vertical direction 6, and can be emitted such that a portion of the actuator assembly 111 or the needle 76 partially occludes the light L. Alternatively, the light L can be emitted such that a portion of the actuator assembly 111 or the needle 76 reflects the light L. After steps 302 and 306, the method 300 includes determining a position of the needle 76 at a discrete point in time based upon the feedback received by the controller 166 from the receiver 156 in step 310. After or concurrently with step 310, in step 314 the controller 166 can determine the velocity of the needle 76 at a discrete moment in time based upon the feedback received by the controller 166 from the receiver 156.

After the position and/or velocity of the needle is determined in steps 310 and 314, the controller 166 can adjust the operation of the piezoelectric device 112 in step 318 based upon feedback received by the controller 166 from the receiver 156. This adjustment can be accomplished by adjusting the voltage supplied to the piezoelectric device 112 according to a predetermined relationship between voltage and needle velocity or position that is stored in the memory 170. The adjustment can be determined using any of one or combination of the control loops 200*a*-200*c* shown in FIGS. 5A-5C, each of which incorporates an input provided by a user of the applicator 10 to the HMI device 174. The adjusting step 318 can include decreasing the voltage supplied to the piezoelectric device 112 when the velocity of the needle 76 is above a predetermined threshold, increasing the voltage supplied to the piezoelectric device 112 when the velocity of the needle 76 is below a predetermined threshold, or maintaining the voltage supplied to the piezoelectric device 112 when the velocity of the needle 76 is within a predetermined range.

By continuously obtaining feedback on the position and velocity of the needle 76, and using this information to control the voltage waveform provided to the piezoelectric device 112, a material dot size and shape jetted from the applicator 10 can be kept consistent over time. The use of the emitter 154 and receiver 156 of the sensor assembly 138 provides a highly accurate system for obtaining this feedback, such that accurate determinations of instantaneous needle 76 position and velocity can be easily obtained. Further, the control loops 200*a*-200*c* can use the information obtained by the controller 166 from the sensor assembly 138 to help adjust the voltage provided by the piezoelectric device 112, while minimizing negative consequences that can come from taking such corrective action.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Descriptions of exemplary methods or processes are not limited to inclusion of all steps as being required in all cases, nor is the order that the steps are presented to be construed as required or necessary unless expressly so stated.

What is claimed is:

1. A method of controlling needle motion of a material applicator that includes an actuator assembly coupled to a needle, the method comprising:

actuating a piezoelectric device of the actuator assembly such that the needle translates along a vertical direction;

emitting light from an emitter to a receiver such that a portion of the actuator assembly or a portion of the needle occludes a portion of the light and the receiver receives a non-occluded portion of the light; and adjusting operation of the piezoelectric device based upon feedback from the receiver and a voltage waveform provided to the piezoelectric device.

2. The method of claim 1, further comprising jetting an amount of a material from a nozzle with the needle.

3. The method of claim 2, wherein the adjusting step includes adjusting a voltage provided to the piezoelectric device to maintain a constant size and shape of the material jetted from the nozzle.

4. The method of claim 1, wherein the emitting step includes emitting the light along a direction that is perpendicular to the vertical direction.

5. The method of claim 1, further comprising adjusting a sensor holder that supports the emitter and the receiver along the vertical direction.

6. The method of claim 1, wherein the actuating step includes transitioning the needle between 1) a first position where the needle is spaced from a valve seat of a nozzle; and 2) a second position where the needle contacts the valve seat to jet an amount of a material from the nozzle.

7. The method of claim 1, further comprising determining a position or a velocity of the needle based on the feedback received from the receiver.

8. The method of claim 7, wherein the adjusting step includes decreasing a voltage supplied to the piezoelectric device when the velocity is above a predetermined threshold.

9. The method of claim 7, wherein the adjusting step includes increasing a voltage supplied to the piezoelectric device when the velocity is below a predetermined threshold.

10. The method of claim 7, wherein the adjusting step including adjusting a voltage supplied to the piezoelectric device based on a stored relation between the velocity of the needle and the voltage.

11. The method of claim 7, wherein the determining step includes continuously determining the position and the velocity of the needle based on the feedback received from the receiver.

12. The method of claim 1, further comprising implementing a control loop that includes feedback control, wherein the feedback control adjusts a voltage provided to the piezoelectric device based on a comparison between the feedback received from the receiver and the voltage waveform.

13. The method of claim 1, wherein the emitting step is initiated before performing the actuating step.

14. The method of claim 1, wherein the emitting step is initiated after performing the actuating step.

15. The method of claim 1, wherein the emitting step is initiated during performance of the actuating step.

16. A method of controlling needle motion of a material applicator that includes an actuator assembly coupled to a needle, the method comprising:

actuating a piezoelectric device of the actuator assembly such that the needle translates along a vertical direction between 1) a first position where the needle is spaced from a valve seat of a nozzle; and 2) a second position where the needle contacts the valve seat to jet an amount of a material from the nozzle;

emitting light from an emitter to a receiver such that a portion of the actuator assembly or a portion of the needle occludes a portion of the light and the receiver receives a non-occluded portion of the light; and implementing a control loop that includes feedback control, wherein the feedback control adjusts a voltage provided to the piezoelectric device of the actuator assembly based on a comparison between feedback received from the receiver and a desired voltage waveform provided to the piezoelectric device to maintain a constant size and shape of the material jetted from the nozzle.

17. The method of claim 16, wherein the desired voltage waveform provided to the piezoelectric device comprises:

an increasing section where a voltage provided to the piezoelectric device increases;

a dwell section after the increasing section that defines a constant voltage; and a decreasing section after the dwell section where the voltage provided to the piezoelectric device decreases, wherein the decreasing section defines a greater magnitude rate of voltage change than the increasing section.

18. The method of claim 17, further comprising adjusting the dwell section of the desired voltage waveform.

19. The method of claim 17, further comprising adjusting the decreasing section of the desired voltage waveform.

20. The method of claim 16, wherein the emitting step is initiated before performing the actuating step.

21. The method of claim 16, wherein the emitting step is initiated after performing the actuating step.

22. The method of claim 16, wherein the emitting step is initiated during performance of the actuating step.

23. The method of claim 16, further comprising adjusting a sensor holder that supports the emitter and the receiver along the vertical direction.

24. The method of claim 16, further comprising determining a position or a velocity of the needle based on the feedback received from the receiver.

25. The method of claim 24, wherein the determining step includes continuously determining the position and the velocity of the needle based on the feedback received from the receiver.

* * * * *